US005678344A

United States Patent [19]

Jones et al.

[11] Patent Number: 5,678,344

[45] Date of Patent: Oct. 21, 1997

[54] FIREARM CASING DEVICE

[76] Inventors: Brent Jones, P.O. Box 2267, Greer, S.C. 29652; Robert Lawrence Parker, Rte. One, Box 204, Clarkshill, S.C. 29821; Phillip Durham, P.O. Box 2267, Greer, S.C. 29652

[21] Appl. No.: 669,000

[22] Filed: Jun. 24, 1996

[51] Int. Cl.[6] ..... F41A 35/04

[52] U.S. Cl. ..... 42/96

[58] Field of Search ..... 42/96; 206/317

[56] References Cited

U.S. PATENT DOCUMENTS

| | | | |
|---|---|---|---|
| Re. 32,752 | 9/1988 | Kiang | 150/52 R |
| 2,364,340 | 12/1944 | Bogg, Jr. | 42/1 |
| 3,437,247 | 4/1969 | Gantress | 324/2 |
| 3,574,965 | 4/1971 | Seiger | 42/1 |
| 3,665,990 | 5/1972 | Hefner, Jr. | 150/52 R |
| 3,701,371 | 10/1972 | Stackhouse | 150/52 R |
| 3,865,166 | 2/1975 | Pedro | 150/52 R |
| 4,280,644 | 7/1981 | Shindelka | 224/149 |
| 4,328,633 | 5/1982 | Pachmayr et al. | 42/74 |
| 4,433,500 | 2/1984 | Kunevicius | 42/1 N |
| 4,644,987 | 2/1987 | Kiang | 150/52 R |
| 4,754,498 | 7/1988 | Stinemates | 2/17 |
| 4,756,456 | 7/1988 | Schauer | 224/150 |

FOREIGN PATENT DOCUMENTS

| | | |
|---|---|---|
| 235290 | 9/1910 | Germany . |

*Primary Examiner*—Charles T. Jordan
*Assistant Examiner*—Meena Chelliah
*Attorney, Agent, or Firm*—Hardaway Law Firm PA

[57] ABSTRACT

A casing for protecting firearms from the elements while allowing the user to access firearm sight and trigger. Although the firearm is at all times fully enclosed in the cover, the firearm may be aimed and discharged without having to remove the firearm from its protective casing.

12 Claims, 3 Drawing Sheets

FIREARM CASING DEVICE

BACKGROUND OF THE INVENTION

The present invention is generally related to the art of firearm casings. More particularly, this invention is related to a protective cover for a firearm which permits the firearm to be sighted and discharged while remaining protected from the elements.

There are various apparatuses which can be employed to encase a firearm, these implements are generally unsatisfactory as they do not permit use of a firearm sight while the firearm is enclosed in the casing. Various gun casings and covers and their method's construction are known and found in the prior art. U.S. Pat. No. 3,865,166 to Pedro shows a molded plastic case for protecting firearms.

Gantress, in U.S. Pat. No. 3,437,247 discloses a cover for protecting a rifle from the elements while permitting the firearm, enclosed in the cover, to be fired. However, Gantress's apparatus does not permit use of a sight while the rifle is enclosed in the cover. U.S. Pat. No. 4,756,456 to Schauer shows a gun case for protecting a rifle from the elements while being carried in the field. Schauer's apparatus calls for the firearm to be removed from the case before discharging of the rifle can take place.

U.S. Pat. No. 3,701,371 to Stackhouse shows a storable gun case small enough to fit in a person's shirt pocket to which case has openings permitting the triggering of a gun while in the case. However, Stackhouse's apparatus does not permit a firearm to be aimed utilizing its sight while so encased.

While devices such as those described above exist, there are still problems associated with the use of firearms which are not addressed.

SUMMARY OF THE INVENTION

It is thus an object of the present invention to provide a means for protecting a firearm from the elements while accessing a sight in aiming and discharging the firearm.

It is a further object of the invention to provide such protection adaptable to various kinds and sizes of firearm telescopic sights.

It is yet another object of the invention to provide such protection which is easily portable.

These and other objects of this invention are provided by a casing for protecting a firearm from the elements, comprising: an elongated cover in the shape of a firearm. The cover having opposing panels forming an upper longitudinal edge, a lower longitudinal edge, a stock end and a terminal aperture. The lower longitudinal edge having an access opening permitting insertion of a firearm and access to a firearm trigger. The access opening having a first fastener for closing the access opening. The upper longitudinal edge defines a sight aperture for accessing a sight. The sight aperture having a second fastener for closing the sight aperture. The second fastener may be a zipper. The cover may also have a flap folded over the sight aperture and secured to the cover by a third fastener. The terminal aperture having a fourth fastener for closing the terminal aperture.

DETAILED DESCRIPTION

In accordance with this invention, it has been found that a firearm cover can be provided to enclose and protect a firearm from the elements while enabling the user to access the firearm sight, trigger and carrying strap. The protective cover maintains the rifle in a state of readiness and permits the rifle to be discharged while enclosed in the cover.

Figure 1:
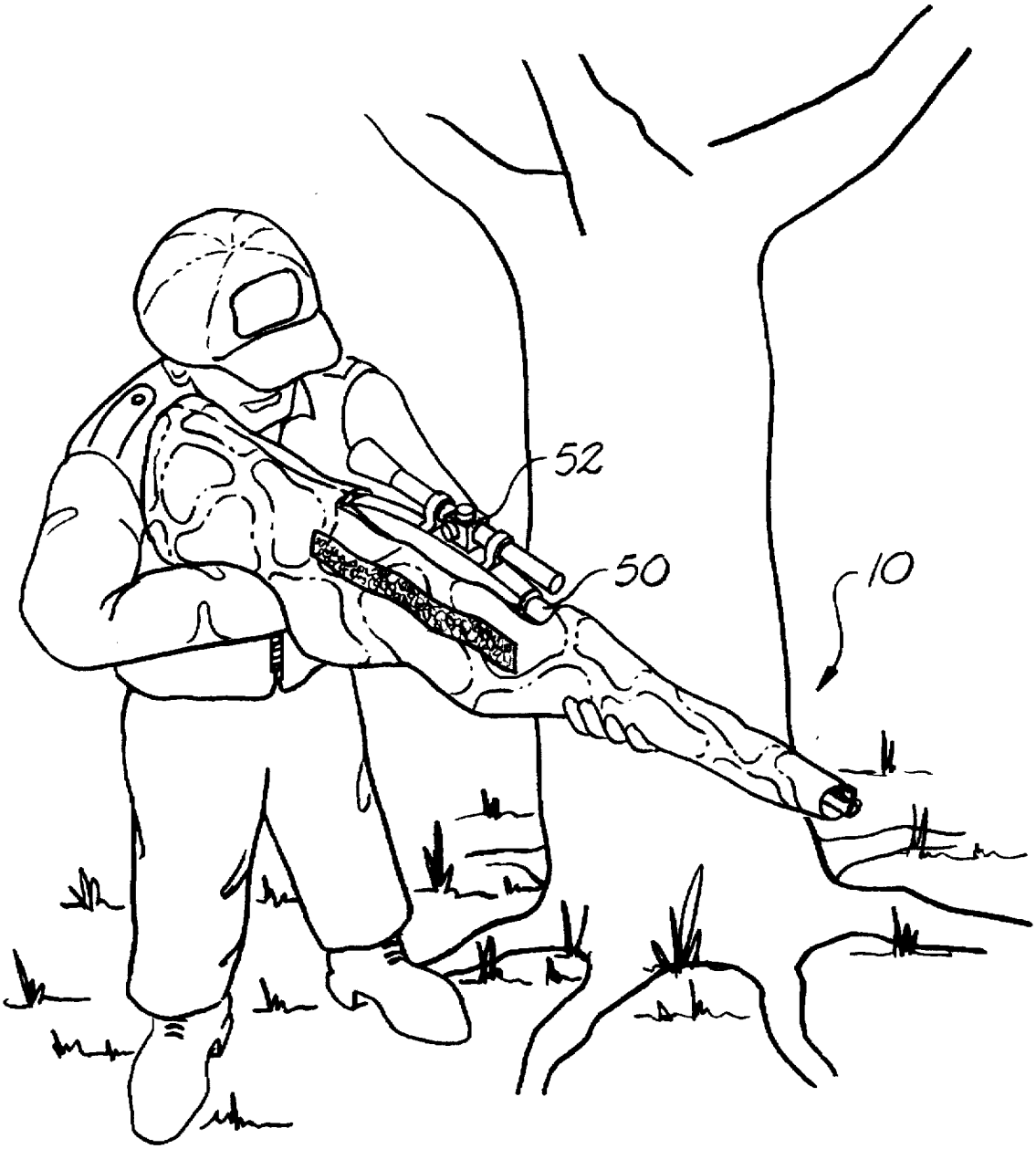
FIG. 1 is an environmental perspective view showing use of a firearm encased in the cover.

FIG. 1 shows use of a conventional hunting rifle enclosed in protective cover 10. Firearm 50 is equipped with conventional telescopic sight 52. Cover 10 encases firearm 50 yet permits the user to access telescopic sight 52 to more accurately aim and discharge firearm 50. Thus, firearm 50 is protected from the elements while enclosed in cover 10 yet sight 52 remains accessible.

Figure 2:
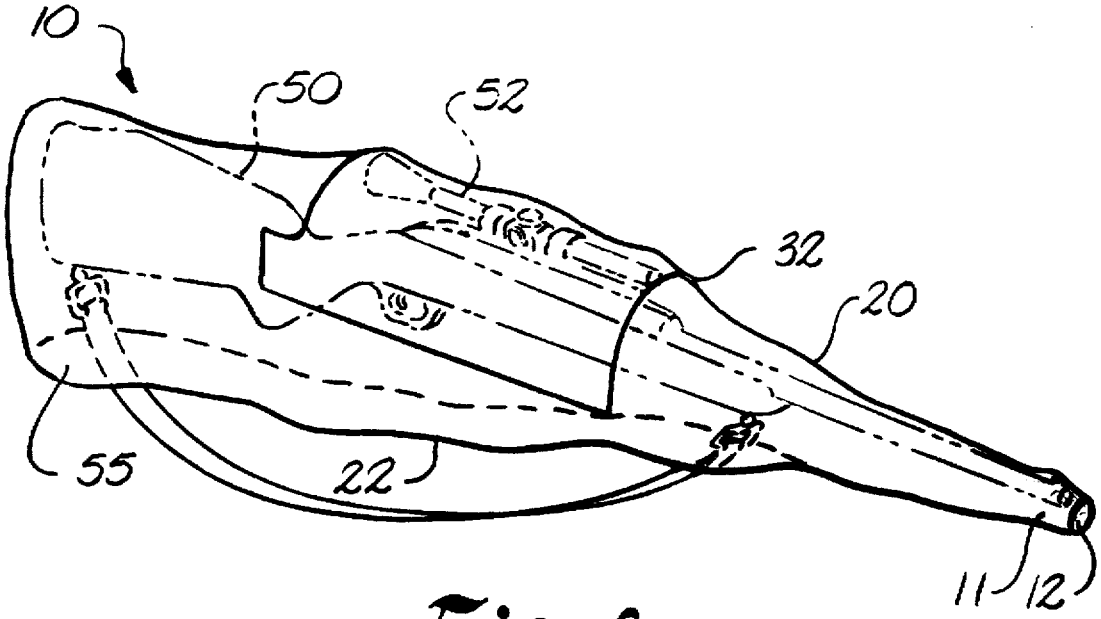
FIG. 2 is a side perspective view illustrating a firearm, in phantom, encased within the cover.
Figure 3:
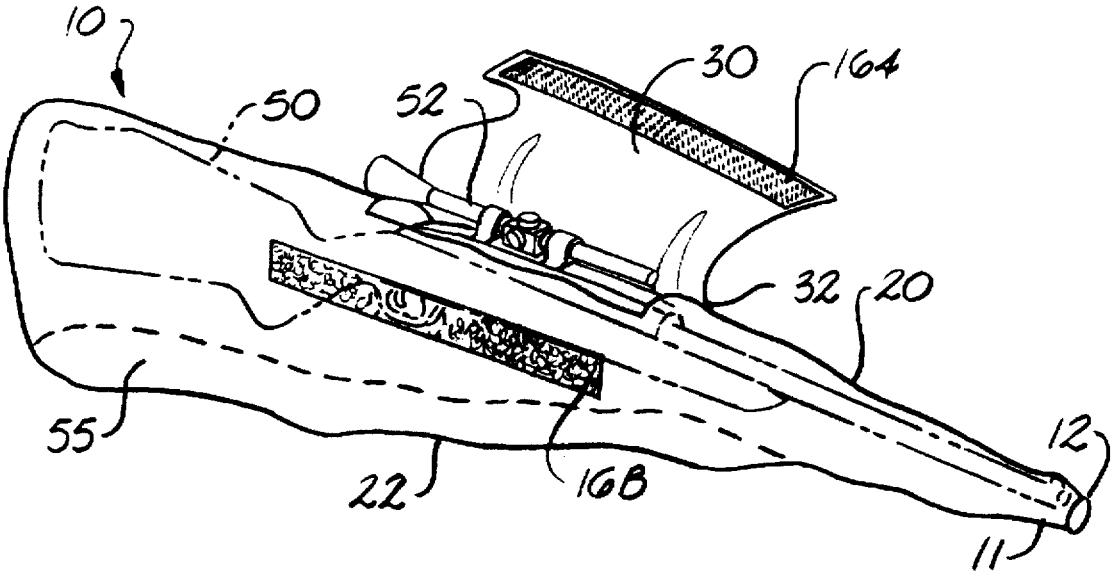
FIG. 3 is a side perspective view of firearm cover illustrating accessibility of the sight.

FIGS. 2 and 3 illustrate cover 10, generally, having opposing panels 11 and 12. Cover 10 may be fabricated from a suitable water-resistant material, which is preferably camouflaged. Panels 11 and 12 may be fabricated from any number of water-impermeable materials such as GORTEX® fabric, vinyl or sturdy canvas treated with a water repellant finish.

Figure 4:
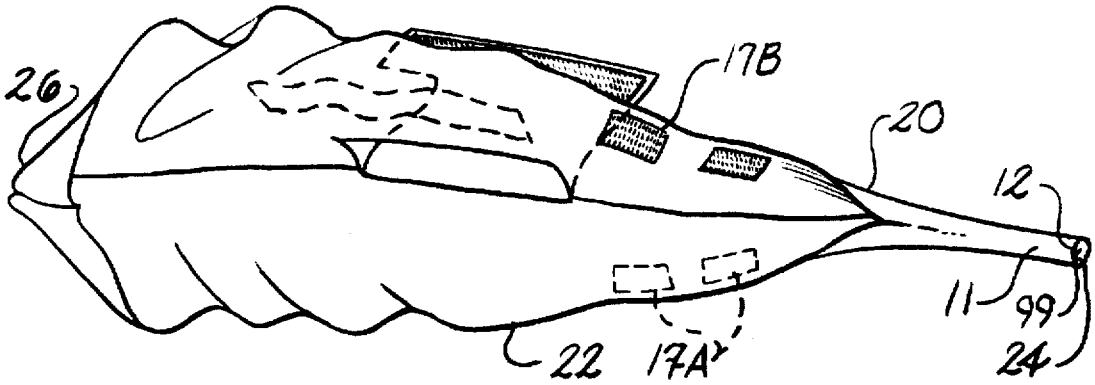
FIG. 4 is a bottom perspective view showing the firearm cover's access opening.

Firearm 50 is enclosed in cover 10. Cover 10 has upper longitudinal edge 20 having sight opening 32 formed therein for accessing sight 52. Cover 10 also has lower longitudinal edge 22 which is selectively sealed along portions of panels 11 and 12 to form access opening 55 which permits insertion of a firearm. Once a firearm is inserted into cover 10, the unsealed portions of lower longitudinal edge 22 permit access and use of the rifle's trigger and attached carrying strap, if any. FIG. 4 shows how the unsealed part of lower longitudinal edge 22 may be selectively closed by a first fastener, for example hook 17A and loop 17B. Other fastening methods may be employed such as zippers, buttons and snaps.

Contiguous with both upper longitudinal edge 20 and lower longitudinal edge 22 is stock end 26 which may be formed by joining the respective edges of panels 11 and 12. Terminal aperture 24, opposite stock end 26, permits a firearm to be discharged while encased in cover 10. Terminal aperture 24 may be selectively closed around barrel of firearm 50 by a fourth fastener 99, for example, a hook and loop fastener.

FIG. 3 shows extension of sight 52 from sight aperture 32. An extended portion of panel 12 or a third panel, which may be detachable, forms flap 30. FIG. 3 illustrates flap 30 in an open position. Flap 30 may be repositioned over sight 52 and held in place by a third fastener, for example hook 16A and loop 16B. Other fastening methods may be employed such as zippers, buttons and snaps.

Alternatively, cover 10 is formed so that when folded in half, it is of a size and shape suitable to enclose firearm 50. Cover 10 may be formed from a single sheet of flexible material which is folded over to form upper longitudinal edge 20 and sealed along stock end 26 and portions of lower longitudinal edge 22.

Figure 5:
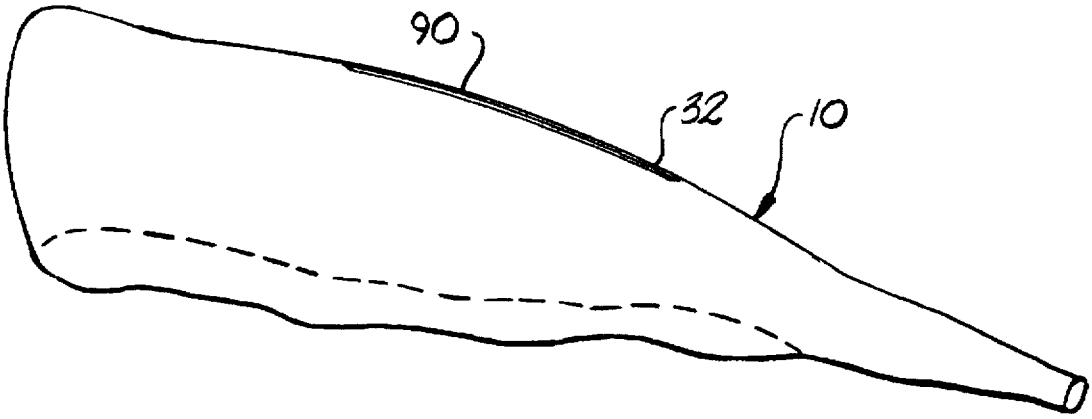
FIG. 5 is a side perspective view of an alternative embodiment of firearm cover.
Figure 5A:
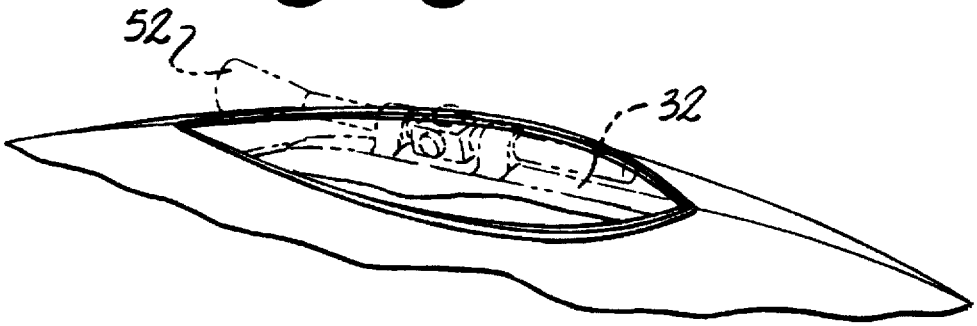
FIG. 5A is a side perspective view of an alternative embodiment of a firearm cover showing a telescopic sight in phantom.

FIG. 5 illustrates an alternative embodiment of cover 10. In this embodiment, sight aperture 32 is selectively closable by a second fastener, for example, zipper 90. A re-closeable plastic zipper (ZIPLOCK®) zipper may be used. FIG. 5A shows sight 52 extended through sight aperture 32.

While not particularly shown in the drawings, it is envisioned that cover may contain pockets and elastic bands to hold small objects such as cartridges and bullets. Also, cover 10 may have a strap to permit firearm 50 enclosed in cover 10 to be carried in the field. Furthermore, cover 10 may be easily folded and carried in the field and is thus accessible when needed.

It is thus seen that in accordance with this invention a casing apparatus is provided which permits the enclosed firearm to be aimed, utilizing a sight, and discharged. As variations will become apparent to those of skill in the art from reading of the above description, such variations are embodied within the spirit and scope of the invention as defined by the following appended claims.

We claim:

1. An apparatus for protecting a firearm, comprising:

(a) a cover for enclosing a firearm protecting it from the elements;

(b) a sight aperture defined by said cover for allowing a sight to project from said cover;

(c) a first fastener for closing said cover so that a firearm is fully encased therein; and (d) a second fastener for closing said sight aperture.

2. The apparatus of claim 1, wherein said second fastener is a zipper.

3. An apparatus for protecting a firearm, comprising:

(a) a cover for enclosing a firearm protecting it from the elements;

(b) a sight aperture defined by said cover for allowing a sight to project from said cover;

(c) a first fastener for closing said cover so that a firearm is fully encased therein; and (d) wherein said cover further comprises a flap folded over said sight aperture and secured to said cover by another fastener.

4. A casing for protecting a firearm from the elements, comprising:

(a) a fabric cover following the contour of a firearm, said cover having opposing panels;

(b) said cover having an upper longitudinal edge, said upper longitudinal edge having a sight aperture formed therein for accessing a sight;

(c) said cover having a lower longitudinal edge, said lower longitudinal edge having an access opening formed therein for inserting and accessing a firearm;

(d) said cover having a stock end contiguous with both said upper longitudinal edge and said lower longitudinal edge; and (e) said cover defining a terminal aperture opposite said stock end.

5. The apparatus of claim 4, wherein said access opening further includes a first fastener for closing said access opening.

6. The apparatus of claim 5, wherein said sight aperture further includes a second fastener for closing said sight aperture.

7. The apparatus of claim 6, wherein said second fastener is a zipper.

8. The apparatus of claim 6, wherein said cover further comprises a flap folded over said sight aperture and secured to said cover by a third fastener.

9. The apparatus of claim 8, wherein said terminal aperture further includes a fourth fastener for closing said terminal aperture.

10. A casing for protecting a firearm from the elements, comprising:

(a) an elongated cover in the shape of a firearm;

(b) said cover having opposing panels, said panels forming an upper longitudinal edge, a lower longitudinal edge, a stock end and a terminal aperture;

(c) said lower longitudinal edge having an access opening permitting insertion of a firearm and access to a firearm trigger;

(d) said access opening having a first fastener for closing said access opening;

(e) said upper longitudinal edge having a sight aperture defined by said panels for accessing a sight;

(f) said sight aperture having a second fastener for closing said sight aperture; and (g) said terminal aperture having a third fastener for closing said terminal aperture.

11. The apparatus of claim 10, further comprising a flap folded over said sight aperture and secured to said cover by a fourth fastener.

12. The apparatus of claim 10, wherein said second fastener is a zipper.

* * * * *